US009697939B2

(12) United States Patent
Takayama et al.

(10) Patent No.: US 9,697,939 B2
(45) Date of Patent: Jul. 4, 2017

(54) SUPERCONDUCTIVE COIL DEVICE

(71) Applicant: Kabushiki Kaisha Toshiba, Minato-ku (JP)

(72) Inventors: Shigeki Takayama, Yokohama (JP); Kei Koyanagi, Yokohama (JP); Hiroshi Miyazaki, Yokohama (JP); Kenji Tasaki, Nakano (JP); Taizo Tosaka, Yokohama (JP); Yusuke Ishii, Yokohama (JP)

(73) Assignee: Kabushiki Kaisha Toshiba, Minato-ku (JP)

( * ) Notice: Subject to any disclaimer, the term of this patent is extended or adjusted under 35 U.S.C. 154(b) by 39 days.

(21) Appl. No.: 14/766,855

(22) PCT Filed: Mar. 14, 2014

(86) PCT No.: PCT/JP2014/001469

§ 371 (c)(1),
(2) Date: Aug. 10, 2015

(87) PCT Pub. No.: WO2014/141720

PCT Pub. Date: Sep. 18, 2014

(65) Prior Publication Data

US 2015/0380138 A1 Dec. 31, 2015

(30) Foreign Application Priority Data

Mar. 15, 2013 (JP) ..... 2013-053260

(51) Int. Cl.
*H01F 6/06* (2006.01)

(52) U.S. Cl.
CPC ..... *H01F 6/06* (2013.01)

(58) Field of Classification Search
CPC ..... H01F 6/06
See application file for complete search history.

(56) References Cited

FOREIGN PATENT DOCUMENTS

| | | |
|---|---|---|
| JP | 2009 49040 | 3/2009 |
| JP | 2009 301992 | 12/2009 |
| JP | 2010 118457 | 5/2010 |
| JP | 2011 91094 | 5/2011 |

OTHER PUBLICATIONS

Machine generated translation of JP2009049040, pp. 1-14, printed Dec. 14, 2016.*

(Continued)

*Primary Examiner* — Colleen Dunn
(74) *Attorney, Agent, or Firm* — Oblon, McClelland, Maier & Neustadt, L.L.P.

(57) ABSTRACT

According to an embodiment, a superconductive coil device includes a non-coplanar three-dimensional superconductive saddle type coil including a wound superconductive wire. The superconductive saddle type coil includes: longitudinal portions extending along a longitudinal direction of a magnetic field generation area; crossing portions extending along an edge line of a cross section perpendicular to the longitudinal direction of the magnetic field generation area; and bent portions connecting the longitudinal portions and the crossing portions. The crossing portions are linear in shape when seen in the longitudinal direction.

4 Claims, 10 Drawing Sheets

(56) References Cited

OTHER PUBLICATIONS

Machine generated translation of JP20100118457, pp. 1-12, printed Dec. 14, 2016.*
Machine generated translation of JP2009301992, pp. 1-13, printed Dec. 14, 2016.*
International Search Report Issued Jun. 17, 2014 in PCT/JP14/001469 Filed Mar. 14, 2014.

* cited by examiner

SUPERCONDUCTIVE COIL DEVICE

TECHNICAL FIELD

Embodiments of the present invention relate to a superconductive coil device.

BACKGROUND ART

In rotating machines such as electric motors, or deflection electromagnets in accelerators, or the like, saddle type coils are typically used. Particularly when a high level of magnetic field intensity is required, superconductive technology is employed.

Meanwhile, in a tape-like superconductive wire such as an yttrium-based superconductive wire, it is difficult to bend the wire in the width direction. If the wire is forcibly bent in the width direction, a large distortion occurs in the superconductor, resulting in a deterioration in the superconductive properties.

Accordingly, in the case of a superconductive coil with a three-dimensional bent portion such as a saddle type coil, in order to reduce the distortion caused by the bending in the width direction, a method of tilting the superconductive wire in the bent portion is employed (e.g., Refer to Patent Documents 1, 2, and 3).

A difference between the length of one end portion of the tape-width direction at the bent portion and the length of the other end portion of the tape-width direction at the bent portion gives a bent distortion in the width direction. This method of tilting the superconductive wire in the bent portion is for decreasing the difference in the length between both of the longitudinal end portions in order to reduce the bent distortion in the width direction.

PRIOR ART DOCUMENTS

Patent Documents

Patent document 1: Japanese Patent Application Laid-Open Publication No. 2011-91094

Patent document 2: Japanese Patent Application Laid-Open Publication No. 2010-118457

Patent document 3: Japanese Patent Application Laid-Open Publication No. 2009-49040

SUMMARY OF THE INVENTION

Problems to be Solved by the Invention

If the bent portion is provided to reduce the distortion of the wire as described above, the longitudinal length of the coil becomes longer. Furthermore, all turns of the superconductive wire are stacked around a coil axis in the radial direction. Moreover, the coils are stacked in the radial direction. As a result, the longitudinal length of the superconductive wire becomes longer, resulting in an increase in the amount of wire to be used.

The object of embodiments of the present invention is to keep the wire from becoming longer in the longitudinal direction while having a three-dimensional bent portion.

Means for Solving the Problem

According to the present invention, there is provided a superconductive coil device comprising a non-coplanar three-dimensional superconductive saddle type coil including a wound superconductive wire, wherein the superconductive saddle type coil includes: longitudinal portions extending along a longitudinal direction of a magnetic field generation area; crossing portions extending along an edge line of a cross section that is perpendicular to the longitudinal direction of the magnetic field generation area; and bent portions each connecting one of the longitudinal portion and one of the crossing portion, and the crossing portions are linear in shape when seen in the longitudinal direction.

Advantage of the Invention

According to the present invention, it is possible to keep the wire from becoming longer in the longitudinal direction while having a three-dimensional bent portion.

DETAILED DESCRIPTION

Hereinafter, with reference to the accompanying drawings, embodiments of a superconductive coil device of the present invention will be described. The same or similar portions are represented by the same reference symbols, and a duplicate description will be omitted.

First Embodiment

Figure 1:
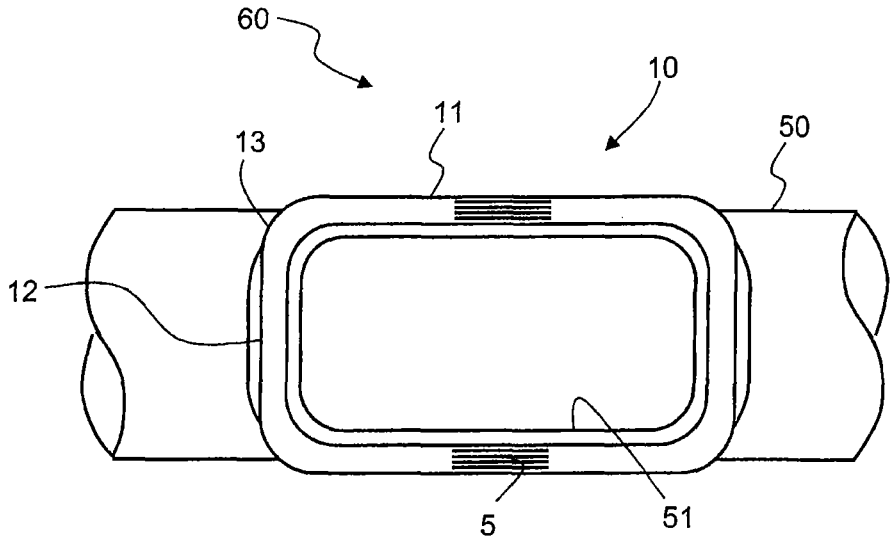
FIG. 1 is a plan view showing the configuration of a superconductive coil device according to a first embodiment.
Figure 2:
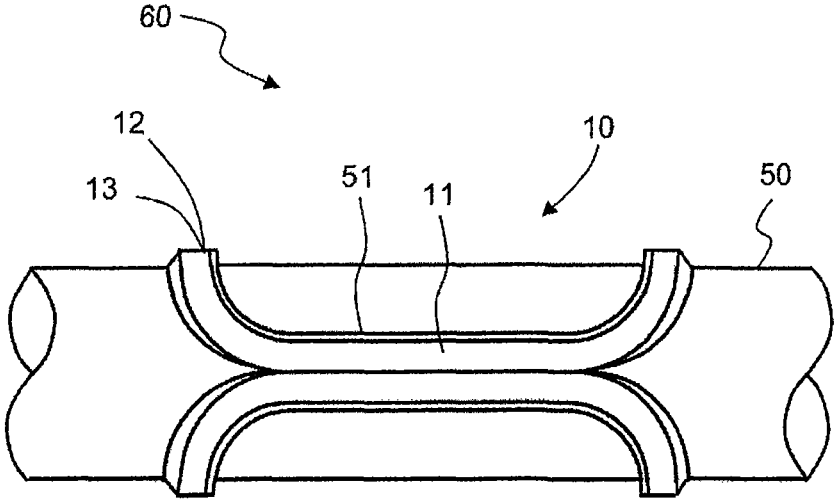
FIG. 2 is a front view of a superconductive coil device according to the first embodiment.
Figure 3:
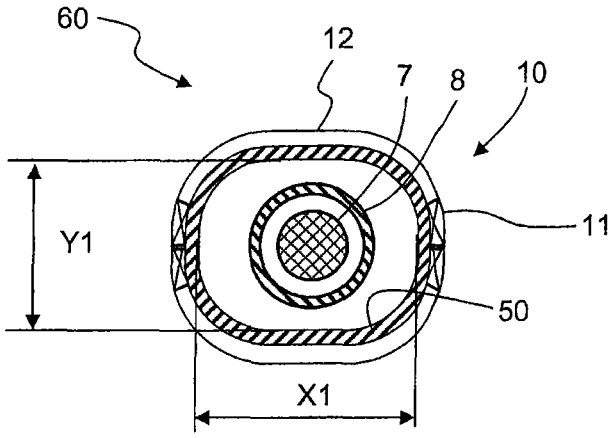
FIG. 3 is a cross-sectional view of a superconductive coil device according to the first embodiment.

FIG. 1 is a plan view showing the configuration of a superconductive coil device according to a first embodiment. FIG. 2 is a front view thereof. FIG. 3 is a cross-sectional view thereof.

A superconductive coil device that is used in a deflection electromagnet for an accelerator will be described as an example.

A superconductive coil device 60 includes a superconductive saddle type coil 10. The superconductive saddle type coil 10 includes a tape-like superconductive wire 5 that is laminated in the thickness direction.

In the superconductive saddle type coil 10, deflection portions 11, crossing portions 12, and bent portions 13 are formed.

The deflection portions 11 extend along the longitudinal direction of a winding shaft 50 as shown in FIGS. 1 and 2. The winding shaft 50 is provided on an outer side of an accelerator duct 8 (Refer to FIG. 3), which is a vacuum pipe through which accelerated particles in the accelerator, in such a way as to extend along the accelerator duct 8.

As shown in FIG. 3, the crossing portions 12 extend along an edge line of a cross section perpendicular to the longitudinal direction of the winding shaft 50.

When the superconductive saddle type coil 10 is seen in the longitudinal direction of the winding shaft 50, the crossing portions 12 are linear in shape.

As shown in FIG. 1, each of the bent portions 13 connects the deflection portion 11 and the crossing portion 12.

The superconductive saddle type coil 10 is assembled by winding the superconductive wire 5 along the winding shaft 50 and around a bobbin 51 mounted on the winding shaft 50. That is, the superconductive wire 5 is wound in such a way that the first turn is performed on the bobbin 51 and the second and subsequent turns are performed along the previous turns. In this manner, the superconductive saddle type coil 10 can be produced.

Instead the superconductive wire 5 may be wound into a planar pancake shape, a race track shape, or a saddle shape in advance, and then an external force may be applied to make the shape of the superconductive saddle type coil 10 of the present embodiment.

When the superconductive wire 5 is placed along the bobbin 51 or the previous turn, the bobbin 51 and the superconductive wire 5 may be bonded together, or the superconductive wires 5 may be bonded mutually. According to this configuration, it is possible to easily realize higher level of winding accuracy.

As shown in FIG. 3, the cross section of the winding shaft 50 is in the shape of a race track. That is, the two lines in the coil axis direction of FIG. 3 (or the upper portion and lower portion that extend in the horizontal direction in the diagram) are straight lines.

The left-side line and right-side line in the FIG. 3 may be semicircular in shape (which includes a shape of half of an ellipse), or a combination of a straight line and curved corners.

Accordingly, in the cross section of the winding shaft 50, width Y1 of the up-down direction (Y-axis direction) is smaller than width X1 of the left-right direction (X-axis direction) in FIG. 3.

In FIG. 3, reference numeral 7 represents a magnetic field space.

Figure 4:
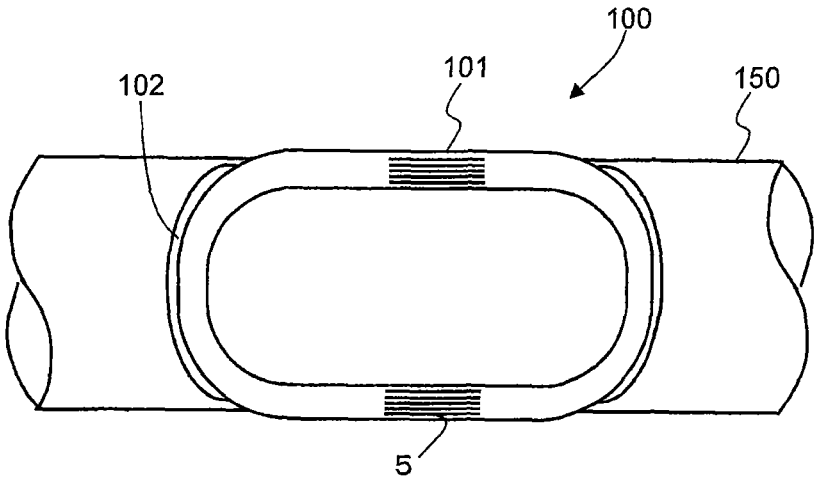
FIG. 4 is a plan view showing the configuration of a conventional superconductive saddle type coil which is compared with the superconductive coil device of the first embodiment.
Figure 5:
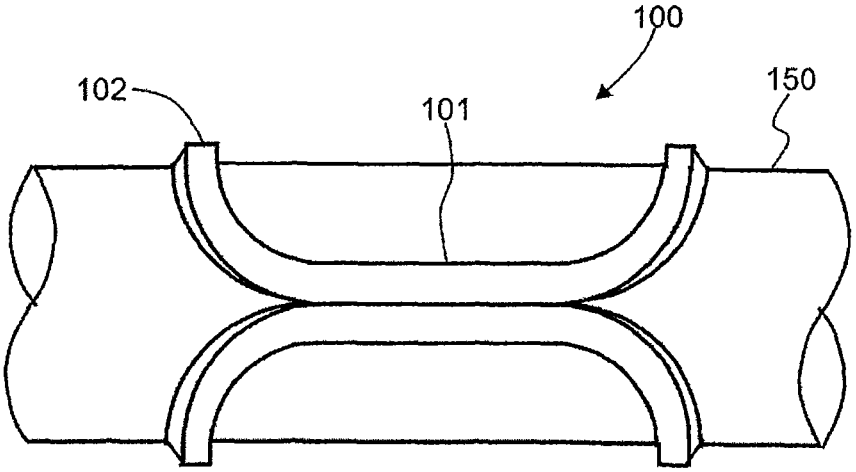
FIG. 5 is a front view of the conventional superconductive saddle type coil which is compared with the superconductive coil device of the first embodiment.
Figure 6:
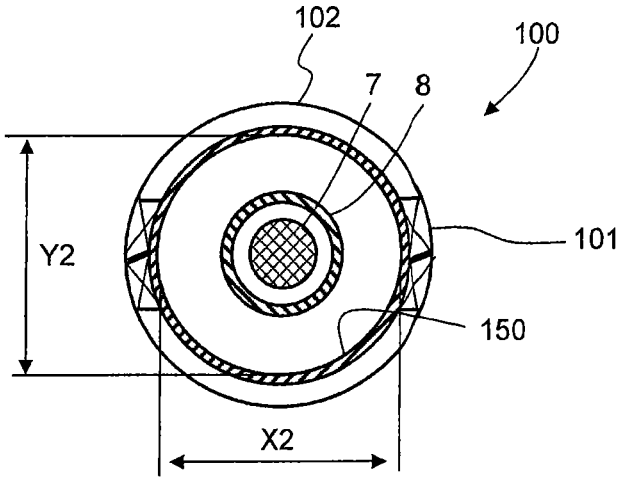
FIG. 6 is a cross-sectional view of the conventional superconductive saddle type coil which is compared with the superconductive coil device of the first embodiment.

FIG. 4 is a plan view showing the configuration of a conventional superconductive saddle type coil which is compared with the superconductive coil device of the first embodiment. FIG. 5 is a front view thereof. FIG. 6 is a cross-sectional view thereof.

As shown in FIGS. 4 and 5, a superconductive saddle type coil 100 includes deflection portions 101 and bent portions 102.

As shown in FIG. 6, the cross section of a winding shaft 150 is circular in shape. Accordingly, in the cross section of the winding shaft 150, width Y2 of the up-down direction (Y-axis direction) in FIG. 6 is equal to width X2 of the left-right direction (X-axis direction).

In the conventional superconductive saddle type coil 100 shown in FIGS. 4 to 6, unlike the superconductive saddle type coil 10 of the superconductive coil device 60 of the present embodiment, there are no such portions as the crossing portions 12 that are linear when seen in the longitudinal direction of the winding shaft 50.

The winding shaft of the conventional superconductive saddle type coil may be elliptical in cross section. The conventional superconductive saddle type coil 100 is formed by winding a wire around a cylindrical or elliptic-cylindrical winding shaft, and a predetermined magnetic field is generated in the magnetic field space 7.

Meanwhile, the coil arrangement in the longitudinal cross section of the superconductive saddle type coil 10 of the superconductive coil device 60 of the first embodiment is almost identical to that of the conventional superconductive saddle type coil 100. Therefore, the magnetic field distribution that is generated in the magnetic field space 7 is almost identical.

The superconductive saddle type coil 10 of the present embodiment will be compared with the conventional superconductive saddle type coil 100 in length.

As for the size of the cross section of the accelerator duct 8, in terms of the formed magnetic field and cooling, the width in the direction in which the accelerator duct spreads on the plane, or the X-axis direction width of FIGS. 3 and 6, is more important than the Y-axis direction width.

Accordingly, since a change in the X-axis direction width is not desirable, suppose that the X-axis direction width X1 of FIG. 3 is equal to the X-axis direction width X2 of FIG. 6. In the case of the present embodiment, the wire is wound along a race track cross section. Therefore, the Y-axis direction height (vertical height) is lower than that of the conventional superconductive saddle type coil. If the coils are equal in the longitudinal-direction width, the total length of the superconductive wire 5 of the present embodiment is shorter than that of the conventional superconductive saddle type coil.

As described above, according to the present embodiment, the total length of the superconductive saddle type coil 10 is less than the total length of the conventional superconductive saddle type coil 100. Therefore, it is possible to efficiently generate the same level of magnetic field distribution as the conventional superconductive saddle type coil 100, with a smaller amount of superconductive wire 5.

Moreover, if a tape-like superconductor is wound, this shape allows the wire to be tilted in the bent portions 13. Therefore, it is possible to wind the wire to make a coil with less distortion.

Second Embodiments

Figure 7:
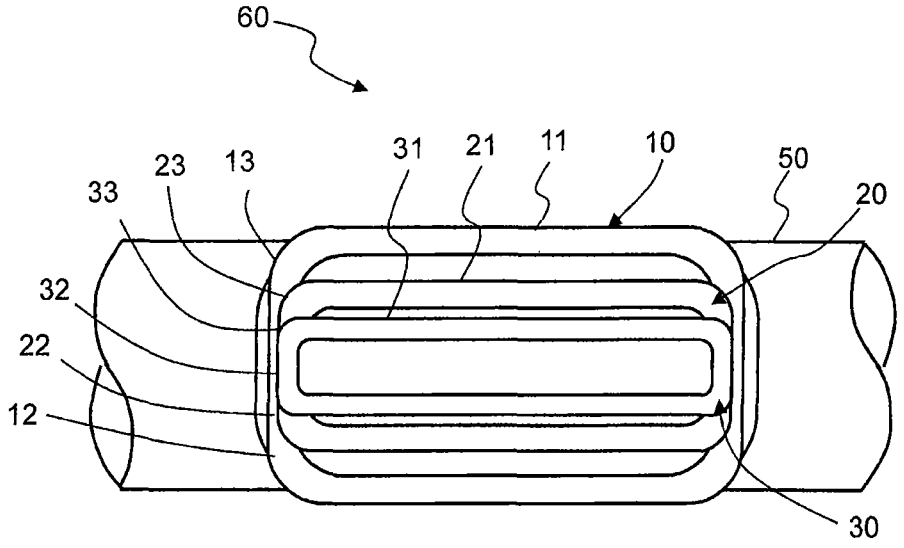
FIG. 7 is a plan view showing the configuration of a superconductive coil device according to a second embodiment.
Figure 8:
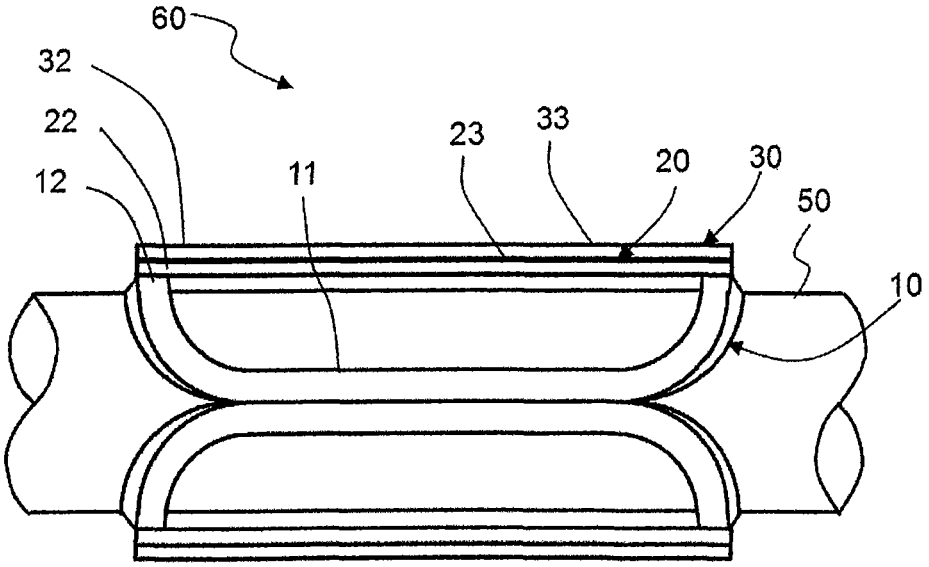
FIG. 8 is a front view showing the configuration of the superconductive coil device according to the second embodiment.
Figure 9:
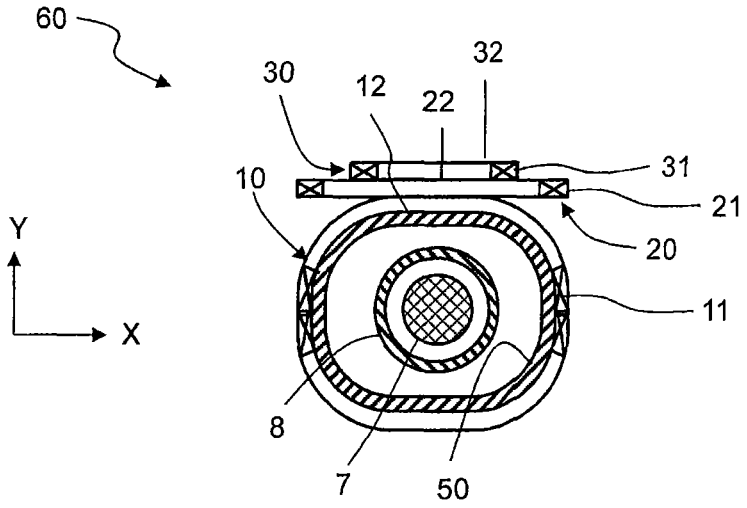
FIG. 9 is a cross-sectional view showing the configuration of the superconductive coil device according to the second embodiment.

FIG. 7 is a plan view showing the configuration of a superconductive coil device according to a second embodiment. FIG. 8 is a front view showing the configuration of the superconductive coil device according to the second embodiment. FIG. 9 is a cross-sectional view showing the configuration of the superconductive coil device according to the second embodiment.

The present embodiment is a variant of the first embodiment. What is shown here is the case where, in order to generate a predetermined magnetic field distribution in a magnetic field space 7, a plurality of superconductive coils are used in combination.

A superconductive coil device 60 of the second embodiment includes a superconductive saddle type coil 10, which is identical to that of the first embodiment; a second superconductive coil 20 and a third superconductive coil 30, which are sequentially stacked on the superconductive saddle type coil 10 in Y-axis direction (or up-down direction in FIG. 9). The second superconductive coil 20 includes deflection portions 21, crossing portions 22, and bent portions 23. The third superconductive coil 30 includes deflection portions 31, crossing portions 32, and bent portions 33.

The length of the second superconductive coil 20 in the longitudinal direction of a winding shaft 50 is equal to the length of the superconductive saddle type coil 10 in the longitudinal direction of a winding shaft 50. The width of the second superconductive coil 20 that is perpendicular to the longitudinal direction of the winding shaft 50, or the distance between the two deflection portions 21, is less than the width of the superconductive saddle type coil 10 that is perpendicular to the longitudinal direction of the winding shaft 50.

The length of the third superconductive coil 30 in the longitudinal direction of a winding shaft 50 is equal to the length of the second superconductive coil 20 in the longitudinal direction of the winding shaft 50. The width of the third superconductive coil 30 that is perpendicular to the longitudinal direction of the winding shaft 50, or the distance between the two deflection portions 31, is less than the width of the second superconductive coil 20 that is perpendicular to the longitudinal direction of the winding shaft 50.

Figure 10:
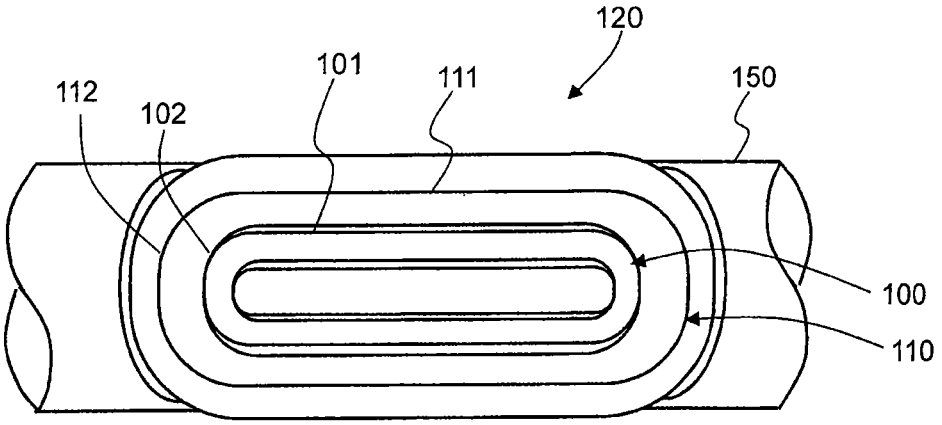
FIG. 10 is a plan view showing the configuration of a conventional superconductive saddle type coil which is compared with the superconductive coil device of the second embodiment.
Figure 11:
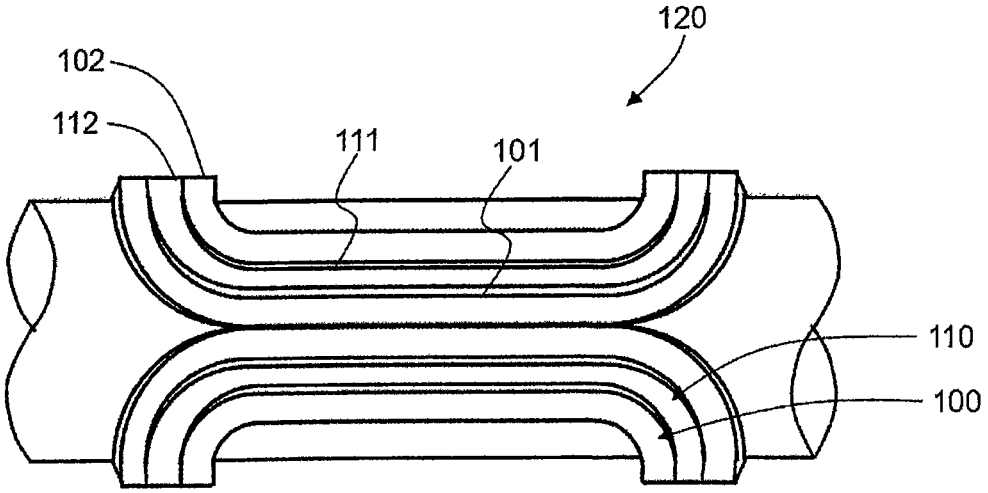
FIG. 11 is a front view showing the configuration of the conventional superconductive saddle type coil which is compared with the superconductive coil device of the second embodiment.
Figure 12:
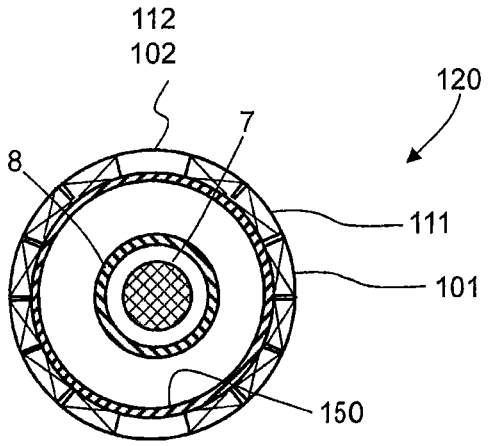
FIG. 12 is a cross-sectional view showing the configuration of the conventional superconductive saddle type coil which is compared with the superconductive coil device of the second embodiment.

FIG. 10 is a plan view showing the configuration of a conventional superconductive saddle type coil which is compared with the superconductive coil device of the second embodiment. FIG. 11 is a front view showing the configuration of the conventional superconductive saddle type coil which is compared with the superconductive coil device of the second embodiment. FIG. 12 is a cross-sectional view showing the configuration of the conventional superconductive saddle type coil which is compared with the superconductive coil device of the second embodiment.

In the case of a conventional superconductive saddle type coil 120, if a plurality of superconductive coils are used in combination in order to generate a predetermined magnetic field distribution in the magnetic field space 7, a second superconductive saddle type coil 110 is provided outside a superconductive saddle type coil 100. However, the coils are not stacked in Y-axis direction; the coil is arranged on the same plane as the first superconductive saddle type coil 100.

Accordingly, the second superconductive saddle type coil 110 is wider than the first superconductive saddle type coil 100. That is, deflection portions 111 of the second superconductive coil 110 are provided outside the deflection portions 101 of the first superconductive coil 100. Moreover, bent portions 112 of the second superconductive coil 110 are provided outside the bent portions 112 of the first superconductive coil 100.

Furthermore, if a third superconductive saddle type coil is provided, as shown in FIGS. 10 and 11, the third superconductive saddle type coil is mounted in such a way as to be wider than the second superconductive saddle type coil 110.

As described above, the magnetic field distribution that is generated in the magnetic field space 7 by the superconductive coil device 60 of the present embodiment is almost identical to the conventional one.

As for the length of the coils, in the superconductive coil device of the present embodiment, the coils are disposed in such a way as to overlap in the Y-axis direction. Therefore, unlike a conventional system in which all turns are arranged in the longitudinal direction, the winding thickness of coils does not extend in the longitudinal direction.

Accordingly, the length of coil is shorter than in the conventional system. As a result, it is possible to efficiently generate the same level of magnetic field distribution as the conventional superconductive saddle type coil with a smaller amount of superconductive wire.

Third Embodiments

Figure 13:
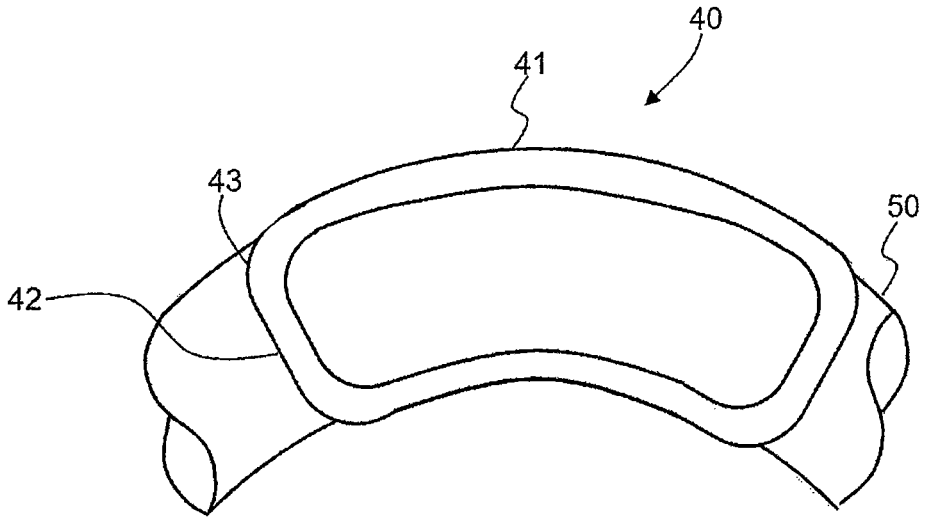
FIG. 13 is a plan view showing the configuration of a superconductive coil device according to a third embodiment.
Figure 14:
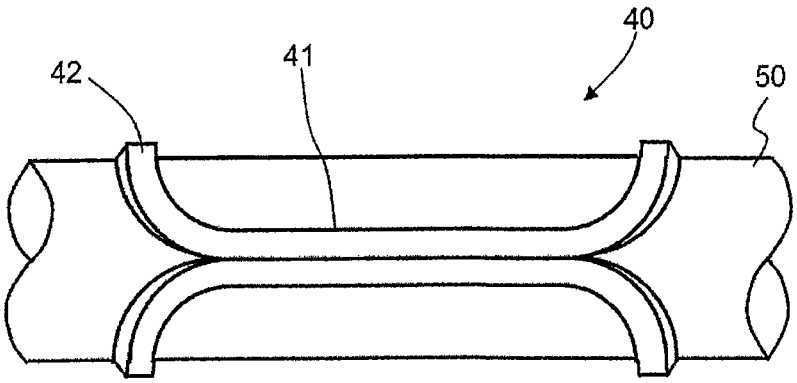
FIG. 14 is a front view showing the configuration of the superconductive coil device according to the third embodiment.
Figure 15:
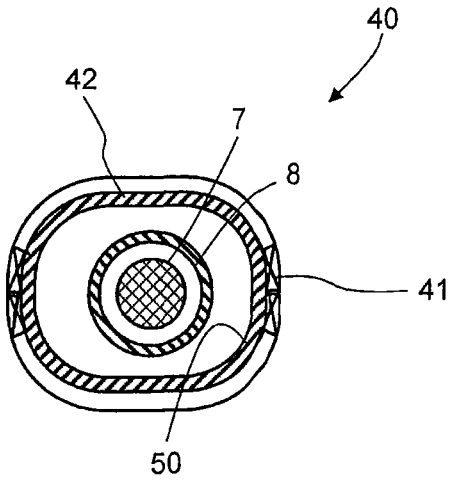
FIG. 15 is a cross-sectional view showing the configuration of the superconductive coil device according to the third embodiment.

FIG. 13 is a plan view showing the configuration of a superconductive coil device according to a third embodiment. FIG. 14 is a front view showing the configuration of the superconductive coil device according to the third embodiment. FIG. 15 is a cross-sectional view showing the configuration of the superconductive coil device according to the third embodiment.

The present embodiment is a variant of the first embodiment. The third embodiment is the same as the first embodiment in that a superconductive saddle type coil 40 includes deflection portions 41, crossing portions 42, and bent portions 43. However, the two deflection portions 41 are formed in such a way as to be bent along the longitudinal direction of a winding shaft 50. It is desirable that the curvature remain constant in each deflection portion 41.

A magnetic field that is formed by the superconductive coil device 60 of the present embodiment having the above configuration is generated in such a way as to be bent in the longitudinal direction in line with the shape of the coil.

In general, a deflection electromagnet in an accelerator is used to form a curved trajectory of particles through a magnetic field. Accordingly, if the magnetic field is generated in such a way as to go along the curved trajectory of the particles, the magnetic field space 7 can be efficiently formed without waste.

Other Embodiments

The present invention is described above by way of several embodiments. However, the embodiments are presented only as examples without any intention of limiting the scope of the present invention.

For example, what has been described in the embodiments is the example of the superconductive coil that is used in a deflection electromagnet of an accelerator. However, the present invention is not limited to this. For example, the present invention may be applied to a coil that is used in a rotating electric machine such as an electric motor. Features of each of the embodiments may be used in combination.

The embodiments may be embodied in other various forms. Various omissions, replacements and changes may be made without departing from the subject-matter of the invention.

The above embodiments and variants thereof are within the scope and subject-matter of the invention, and are similarly within the scope of the invention defined in the appended claims and the range of equivalency thereof.

Explanation of Reference Symbols

5: tape-like superconductive wire, 7: magnetic field space (magnetic field generation area), 8: accelerator duct, 10: superconductive saddle type coil, 11: deflection portions (longitudinal portions), 12: crossing portions, 13: bent portions, 20: second superconductive coil, 21: deflection portions (longitudinal portions), 22: crossing portions, 23: bent portions, 30: third superconductive coil, 31: deflection portions (longitudinal portions), 32: crossing portions, 33: bent portions, 40: superconductive saddle type coil, 41: deflection portions (longitudinal portions), 42: crossing portions, 43: bent portions, 50: winding shaft, 51: bobbin, 60: superconductive coil device, 100: superconductive saddle type coil, 101: deflection portions, 102: bent portions, 110: second superconductive saddle type coil, 111: deflection portions, 112: bent portions, 120: superconductive saddle type coil, 150: winding shaft

The invention claimed is:

1. A superconductive coil device comprising a non-coplanar three-dimensional superconductive saddle type coil including a tape-like superconductive wire, wherein the superconductive saddle type coil includes:

longitudinal portions extending along a longitudinal direction of a magnetic field generation area;

crossing portions extending along an edge line of a cross section that is perpendicular to the longitudinal direction of the magnetic field generation area; and bent portions each connecting one of the longitudinal portion and one of the crossing portion, the super conductive wire is wound and laminated along a winding shaft and a bobbin which is attached to the winding shaft, the crossing portions are linear in shape when seen in the longitudinal direction, and a face of the super conductive wire is inclined from a coil axis in such a way that a distance of the face from the coil axis decreases as a distance of the face from the winding shaft increases at the crossing portion, and that the distance of the face from the coil axis increases as the distance of the face from the winding shaft increases at the longitudinal portion.

2. The superconductive coil device according to claim 1, wherein:

the magnetic field generation area is a part of an accelerator duct, that spreads in a planar direction, of an accelerator;

a plurality of the superconductive saddle type coils are disposed in such a way as to surround the accelerator duct; and a total vertical height of a plurality of the superconductive saddle type coils disposed is less than a total width of the superconductive saddle type coils.

3. The superconductive coil device according to claim 1, further comprising an outer-side coil that includes a wound superconductive wire, wherein the outer-side coil is disposed outside the superconductive saddle type coil in a coil-axis direction.

4. The superconductive coil device according claim 1, wherein the longitudinal portion is bent in the longitudinal direction.

* * * * *